US008235674B1

(12) United States Patent
Bhattacharya et al.

(10) Patent No.: US 8,235,674 B1
(45) Date of Patent: Aug. 7, 2012

(54) PAINT CIRCULATION PUMP CONTROL SYSTEM

(75) Inventors: Shubho Bhattacharya, Dublin, OH (US); Sarah Crush, Dublin, OH (US)

(73) Assignee: Honda Motor Co., Ltd., Tokyo (JP)

( * ) Notice: Subject to any disclaimer, the term of this patent is extended or adjusted under 35 U.S.C. 154(b) by 622 days.

(21) Appl. No.: 12/415,316

(22) Filed: Mar. 31, 2009

(51) Int. Cl.
*F04B 49/03* (2006.01)
*F04B 49/00* (2006.01)

(52) U.S. Cl. ..... 417/46; 417/8; 417/26

(58) Field of Classification Search ..... 417/46, 417/1–8, 16, 26–31, 47
See application file for complete search history.

(56) References Cited

U.S. PATENT DOCUMENTS 4,682,710 A 7/1987 Turner, Jr. et al.
5,074,237 A 12/1991 Ogasawara
5,096,120 A 3/1992 Luckarz
5,223,306 A 6/1993 Bartow
5,230,739 A 7/1993 Bartow
5,309,403 A 5/1994 Bartow
5,460,297 A 10/1995 Shannon et al.
7,293,720 B2 11/2007 Ramsay
2006/0102075 A1 5/2006 Saylor et al.
2006/0177565 A1 * 8/2006 Bhattacharya et al. ..... 427/8
2007/0075163 A1 4/2007 Smith et al.
2007/0207260 A1 9/2007 Collmr et al.

* cited by examiner

*Primary Examiner* — Joseph L Williams
*Assistant Examiner* — Nathaniel Lee
(74) *Attorney, Agent, or Firm* — Rankin Hill & Clark LLP

(57) ABSTRACT

A paint circulation pump control system having a plurality of pneumatic or hydraulic pump assemblies that operate at different outputs in response to load changes on a paint application system is provided. Each pump assembly includes a first regulator and second regulator having different pressure output settings selectively connecting a compressed air source with a pump. A control valve in each pump assembly is responsive to a single switch to connect the compressed air source to the pumps via the first or second regulators. When the switch directs a change, all of the pump assemblies simultaneously change the regulator that is connecting the pump with the compressed air source.

15 Claims, 8 Drawing Sheets

PAINT CIRCULATION PUMP CONTROL SYSTEM

BACKGROUND

In paint application systems wherein liquid paint is applied to an article, a paint circulation system is used to deliver paint to the applicator and to prevent liquid paint from settling or coagulating. The paint circulation systems generally rely on pumps to circulate the liquid paint through a piping loop. While several different types of pumps can be used to circulate the paint, the present disclosure is principally concerned with pneumatic and hydraulic pumps.

Pneumatic pumps are powered by compressed air originating from a compressed air source and directed to the pump. The compressed air directed to the pump causes the pump to stroke. The output of the pump, measured herein as a number of strokes/minute, is directly proportional to the pressure of the compressed air supplied to the pump. As the pressure of the compressed air supplied to the pump increases, the output of the pump increases, and vice-versa. Hydraulic pumps operate on a similar principle, replacing compressed air with pressurized fluid.

Accordingly, by controlling the pressure of the compressed air (or fluid for a hydraulic pump) delivered to the pump, the output of the pump can be controlled. Circulation pump control systems typically operate at the same setting all the time, regardless of whether they are delivering paint (in a production state) or not (in a non-production state.

SUMMARY

The present invention provides a control system for a circulation pump that is responsive to changes in load on the paint application system. Each pump has a pair of pressure regulators (hereinafter referred to as "regulators") and a directional control valve (hereinafter referred to as a "control valve") for selectively feeding fluid to the pump from one of the regulators.

The paint circulation pump control system of the present invention has first and second regulators associated with a pump. The first regulator is adapted to supply fluid at a first pressure to the pump and the second regulator is adapted to supply fluid at a second pressure to the pump, where the second pressure is less than the first pressure. A control valve is interposed between the regulators and a fluid source so as to supply pressurized fluid to either the first regulator or the second regulator. A main switch is connected to the control valve and is adapted to actuate the control valve so to connect the pump to the fluid source via one of the first regulator and the second regulator.

Further, the paint circulation pump control system according to the present invention includes a system having a plurality of pumps that are connected to the fluid source. Each of the pumps has a first regulator, a second regulator, and a control valve associated therewith. The main switch is operable to toggle all pumps simultaneously between receiving fluid at a first pressure or a second pressure.

The present invention also provides a method for operating a paint circulation pump control system. The method includes a first step of detecting a change in a state of the paint application system. The state change is determined to be either from a production state to a non-production state or vice-versa. Each of a plurality of pumps is connected to a fluid source via a first associated regulator when the paint application system is detected to have changed into a production state. Conversely, each of the plurality of pumps is connected to the fluid source via a second associated regulator when the paint application system is detected to have changed into a non-production state. The second regulator is set to supply fluid at a lower pressure than the first regulator.

BRIEF DESCRIPTION OF THE DRAWINGS

The present invention will be described herein with reference to the appended drawings.

DETAILED DESCRIPTION

Figure 1A:
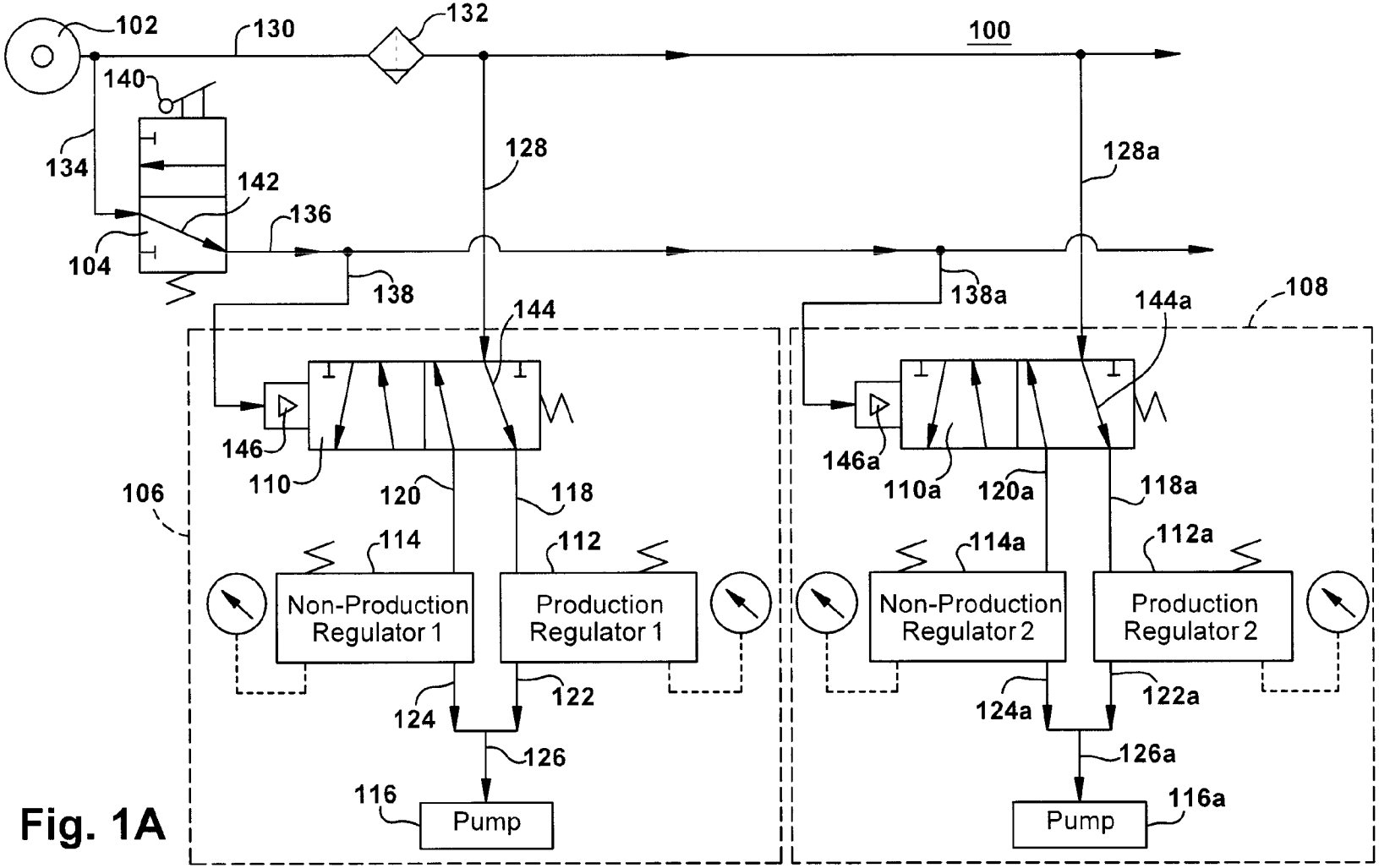
FIG. 1A is a block diagram illustrating a semi-automatic control system for paint circulation pumps in a production state according to the present invention.

The present invention is described below with reference to the appended figures. Description of the invention with reference to drawings is meant to facilitate understanding of the invention, and is not intended to limit the scope of the invention. A person of ordinary skill in the art would recognize that the present invention is amenable to various modifications and additions. To the extent practicable, modifications are discussed herein. However, the absence of a particular modification is not an admission that the modification is outside of the scope of the invention.

Paint circulation and application systems rely on pumps to circulate the paint within the system. To reduce electrical hazards, especially when circulating organic solvent borne paints, which are usually flammable, pneumatic or hydraulic pumps are commonly used. The present disclosure will focus on pneumatic pumps, though a person of ordinary skill in the art can recognize that hydraulic pumps could be used.

Pneumatic pumps are powered by compressed air. Compressed air, originating from a compressed air source, is directed to a pump causing the pump to stroke. The output of the pump, measured herein as strokes/minute, is directly proportional to the pressure of the compressed air supplied to the pump. As the pressure of the compressed air directed to the pump increases, the output of the pump increases, and vice-versa.

Generally, a paint circulation system has several pumps operating to circulate several different paint lines. For the purposes of the present description, each of the separate paint lines is associated with a different paint color. However, the different paint lines can be assigned based on other factors, and more than one paint line can be assigned for each paint color, depending on the frequency with which each paint color is used.

As each of the paint lines communicates a different paint color, and each paint color may have a different viscosity, each paint line's pump output may have to be set differently. Particularly, paint colors having a higher viscosity require the associated circulation pump to operate at a higher output, while the circulation pumps associated with paint colors having a lower viscosity can operate at a lower output while maintaining adequate circulation. Typically, a single compressed air source outputting compressed air at a set pressure is connected to each of the pumps.

To reduce energy consumption, a pump control system according to the present invention accounts for paint application system changes between a production state and a non-production state. In this regard, an exemplary embodiment of the present invention provides each pump with a dual-regulator system, having separate production and non-production regulators. The production regulator for each pump is set to allow higher pressure compressed air to pass to the pump than the non-production regulator. The paint application system is considered in a production state during a paint application shift and is considered in a non-production state between shifts, on weekends, and during holidays.

A control valve interposed between the dual-regulators and the compressed air source selectively makes a connection between the compressed air source, one of the production regulator and the non-production regulator, and the pump. Further, a single main switch simultaneously instructs all of the control valves to connect the compressed air source with the associated pump via either the production regulator or the non-production regulator. By setting the production regulator to regulate the compressed air flow to achieve a pump output required during the higher load production state and the non-production regulator to regulate the compressed air flow to reduce the pump output during the lower load non-production state, the air pressure supplied to the pump can be controlled based on the required pump output, thereby allowing the energy efficiency of the paint circulation system to be improved.

Figure 1B:
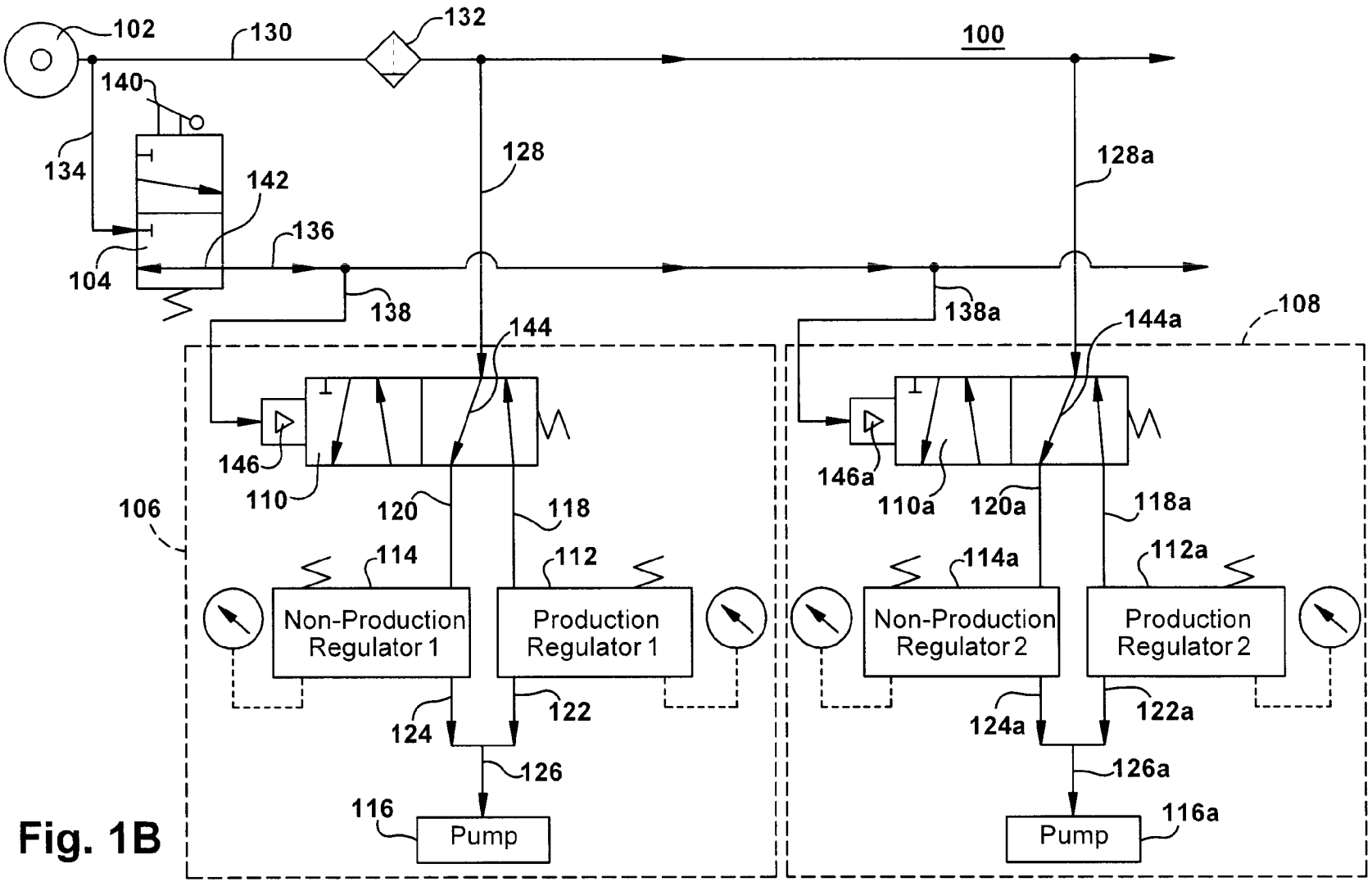
FIG. 1B is a block diagram illustrating the semi-automatic control system for paint circulation pumps in a non-production state according to the present invention.

With reference to FIGS. 1A and 1B, a semi-automatic paint circulation pump control system 100 (hereinafter, "system 100") includes a compressed air source 102 connected to a plurality of circulation pump assemblies 106, 108 via a main line 130 and a principal pilot line 136.

A pneumatic selector switch 104 (hereinafter, "switch 104"), is provided between the compressed air source 102 and the principal pilot line 136. The switch 104 is actuated to either a PRODUCTION position or a NON-PRODUCTION position, according to the state of the paint application system. When in the PRODUCTION position, higher pressure compressed air is directed through the pump assemblies 106, 108 such that the pump assemblies 106, 108 operate at a higher output, according to the higher load during the production state. When the switch 104 is in the NON-PRODUCTION position, lower pressure compressed air is directed through the pump assemblies 106, 108 such that the pump assemblies 106, 108 operate at a lower output, according to the lower load during the non-production state. The operation of the system 100 to change the output of the pump assemblies 106, 108 is described in detail below.

To simplify the explanation of the system 100, only two pump assemblies, a first pump assembly 106 and a second pump assembly 108, are discussed. In practice, most systems will have more than two pump assemblies. Further, the first pump assembly 106 and the second pump assembly 108 have substantially identical components. To further simplify the description of the exemplary embodiment discussed herein, only the first pump assembly 106 will be described in detail. The components of the second pump assembly 108 are denoted by identical reference numerals with the addition of a letter "a".

The first pump assembly 106 includes a direction control valve 110 (hereinafter, "control valve 110"), a production regulator 112 (denoted PRODUCTION REGULATOR 1 in FIGS. 1A and 1B), a non-production regulator 114 (denoted NON-PRODUCTION REGULATOR 1 in FIGS. 1A and 1B), and a pump 116. The control valve 110 is connected to the production regulator 112 via an introductory production line 118, and is connected to the non-production regulator 114 via an introductory non-production line 120. A post production line 122 is connected to the outlet of the production regulator 112 and a post non-production line 124 is connected to the outlet of the non-production regulator 114. The post production line 122 and the post non-production line 124 merge into a single pump line 126, with the pump line 126 feeding into the pump 116.

The control valve 110 selectively connects one of the introductory production line 118 and the introductory non-production line 120 with the compressed air source 102 via the production regulator 112 or the non-production regulator 114, respectively. The regulated compressed air flows through one of the post production line 122 and the post non-production line 124 to the pump line 126 and into the pump 116.

The control valve 110 is fluidly connected with the compressed air source 102 via a valve line 128 extending from the main line 130. The compressed air source 102 outputs compressed air to the main line 130, which passes through a filter 132. The valve line 128 extends from the main line 130 downstream from the filter 132 so as to connect the main line 130 with the control valve 110. To allow for the operation of a plurality of pumps, a valve line 128, 128*a* extends from the main line 130 to each pump assembly 106, 108.

In addition to the main line 130, an introductory switch line 134 extends from the compressed air source 102 and connects the compressed air source 102 to the switch 104. From the switch 104, the principal pilot line 136 feeds a branch pump assembly pilot line 138, 138*a* associated with each pump assembly 106, 108. The pump assembly pilot line 138, 138*a* connects the principal pilot line 136 to the control valve 110, 110*a* of the associated pump assembly 106, 108.

The switch 104 includes a manual actuator 140 that allows an operator to place the switch 104 in one of a PRODUCTION position and a NON-PRODUCTION position. A switch selector line 142 is disposed within the switch 104 and has a proximal end connected to and in fluid communication with the introductory switch line 134. A distal end of the switch selector line 142 is selectively connected to and disconnected from the principal pilot line 136.

When the manual actuator 140 is placed in the PRODUCTION position, as shown in FIG. 1A, the switch selector line 142 is in fluid communication with the principal pilot line 136, thereby connecting the principal pilot line 136 with the compressed air source 102 via the introductory switch line 134. When the manual actuator 140 is placed in the NON-PRODUCTION position, as shown in FIG. 1B, the switch selector line 142 is disconnected from the principal pilot line 136 so as to disconnect the fluid communication between the principal pilot line 136 and the compressed air source 102 via the introductory switch line 134. Accordingly, when the manual actuator 140 is in the NON-PRODUCTION position, the principal pilot line 136 is not connected with the compressed air source 102.

When the manual actuator 140 is in the PRODUCTION position, the switch selector line 142 is connected with the principal pilot line 136 and compressed air passes through the principal plot line 136, into the branch pump assembly pilot line 138, and to the control valve 110. The control valve 110 has a control line 144 that is connected to the valve line 128. The control line 144 is selectively connected to either the introductory production line 118 or the introductory non-production line 120.

When the control line 144 is connected with the introductory production line 118, the production regulator 112 is connected to and in fluid communication with the compressed air source 102 via the main line 130, the valve line 128, the control valve 110 through the control line 144, and the introductory production line 118. When the control line 144 is connected with the introductory non-production line 120, the non-production regulator 114 is connected to and in fluid communication with the compressed air source 102 via the main line 130, the valve line 128, the control valve 110 through the control line 144, and the introductory non-production line 120.

As there is a single control line 144, only one of the production regulator 112 and the non-production regulator 114 are in fluid communication with the compressed air source 102. As such, the pump 116 is only supplied with compressed air that is regulated by one of the production regulator 112 and the non-production regulator 114. As the production regulator 112 is set to allow a higher pressure of compressed air to pass through than the non-production regulator 114, the pressure of compressed air supplied to the pump 116 is changed by changing the regulator that interconnects the pump 116 with the compressed air source 102.

The switch 104 and the control valve 110 cooperate so as to allow for a changing of the regulator interconnecting the pump 116 with the compressed air source 102. As mentioned above, when the manual actuator 140 is in the PRODUCTION position, the switch selector line 142 fluidly connects the introductory switch line 134 to the principal pilot line 136. Conversely, when the manual actuator 140 is in the NON-PRODUCTION position, the switch selector line 142 disconnects the introductory switch line 134 from the principal pilot line 136.

The switch 104 is a valve having an opened and a closed position. The switch 104 operates to selectively block the switch selector line 142, which is a stationary line that connects the introductory switch line 134 with the principal pilot line 136 until blocked. Accordingly, a blocking mechanism is disposed in the switch selector line 142 so as to block the switch selector line 142 when the manual actuator 140 is in the NON-PRODUCTION position and to unblock the switch selector line 142 when the manual actuator 140 is in the PRODUCTION position. For the purposes of explanation herein, the switch selector line 142 will be referred to as being connected when compressed air can pass from the compressed air source 102 through the introductory switch line 134 and the switch selector line 142 to the principal pilot line 136 and disconnected when the principal pilot line 136 is not in fluid communication with the compressed air source 102 via the introductory switch line 134.

When the manual actuator 140 is in the PRODUCTION position and compressed air passes to the principal pilot line 136, the pump assembly pilot line 138 similarly receives compressed air and passes the compressed air to the control valve 110. The control valve 110 is configured such that when compressed air is passing into the control valve 110 from the pump assembly pilot line 138 through the port 146, the control line 144 connects the valve line 128 to the production regulator 112 via the introductory production line 118. Conversely, when there is an absence of compressed air passing into the control valve 110 from the pump assembly pilot line 138, the control line 144 connects the valve line 128 with the non-production regulator 114 via the introductory non-production line 120.

The control valve 110 operates to connect the control line 144 to either the production regulator 112 or the non production regulator 114 through the passage of compressed air through the port 146. The control valve 110 is energized when compressed air is introduced to the port 146 via the pump assembly pilot line 138, and is de-energized when there is no compressed air introduced to the port 146 via the pump assembly pilot line 138. Again, compressed air passes through the pump assembly pilot line 138 only when the manual actuator 140 of the switch 104 is in the PRODUCTION position.

When de-energized, the control valve 110 is in a base position and the control line 144 connects the valve line 128 with the introductory non-production line 120 (as shown in FIG. 1B). When energized, the control valve 110 is in an energized position wherein the control line 144 connects the valve line 128 with the introductory production line 118. To ensure that the control valve 110 returns to the base position when compressed air is no longer introduced via the port 146, the control valve 110 is biased toward the base position.

When the compressed air is introduced to either the production regulator 112 or the non-production regulator 114, the compressed air is regulated such that a set air pressure is output from the regulators to the associated post production line 122 or post non-production line 124. As only one of the production regulator 112 and the non-production regulator 114 is connected with the compressed air source 102, only the connected regulator passes regulated compressed air to the pump 116. As such, the pump 116 only receives compressed air at a pressure that is regulated by the connected regulator. Thus, the pressure of the air supplied to the pump 116 can be controlled by switching between two settings.

Herein, the two settlings are associated with a production state (production regulator 112) and a non-production state (non-production regulator 114). As mentioned above, when the paint application system is in a production state, a relatively higher load is placed on the system. Therefore, a relatively higher output from the pump 116 is required. Accordingly, the production regulator 112 is set so as to allow a relatively higher air pressure through to the pump 116. Conversely, when the paint application system is in a non-production state, a relatively lower load is placed on the system, allowing a relatively lowered output from the pump 116 to maintain sufficient circulation. Accordingly, the non-production regulator 114 is set so as to allow a relatively lower air pressure through to the pump 116.

Notably, in the second pump assembly 108, a production regulator **112*a* and a non-production regulator 114*a* are provided as in the first pump assembly 106. As the second pump assembly 108 may be associated with a different paint line having a different color paint with a different viscosity, the desired/required output of the second pump 116*a* may be different than that of the first pump 116. Accordingly, the settings of the production regulator 112*a* and the non-production regulator 114*a* in the second pump assembly 108 may be different than those of the production regulator 112 and the non-production regulator 114 of the first pump assembly 106**.

Figure 2A:
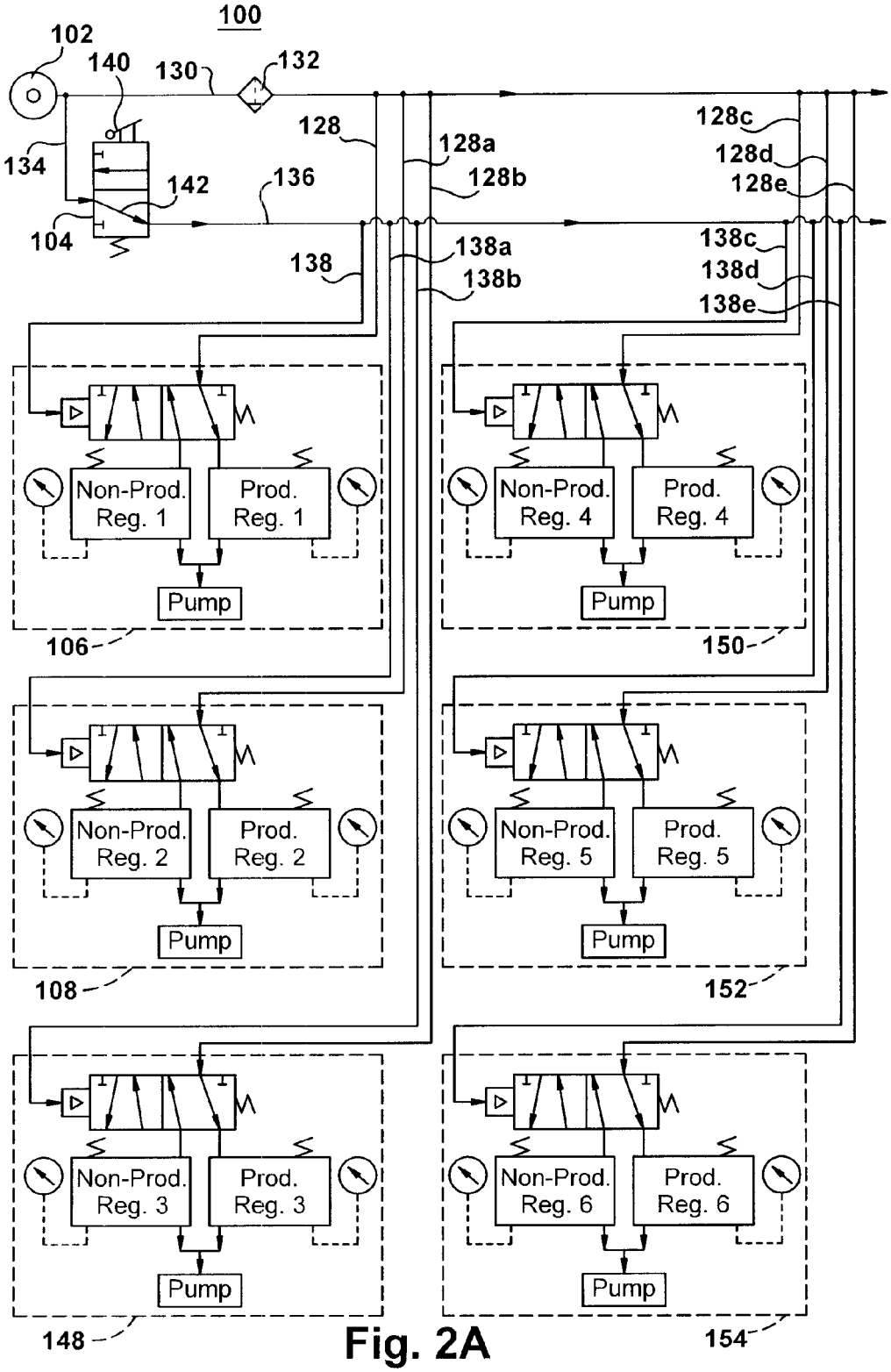
FIG. 2A is a block diagram showing an expanded system of pumps in a production state utilizing the control system according to the present invention.
Figure 2B:
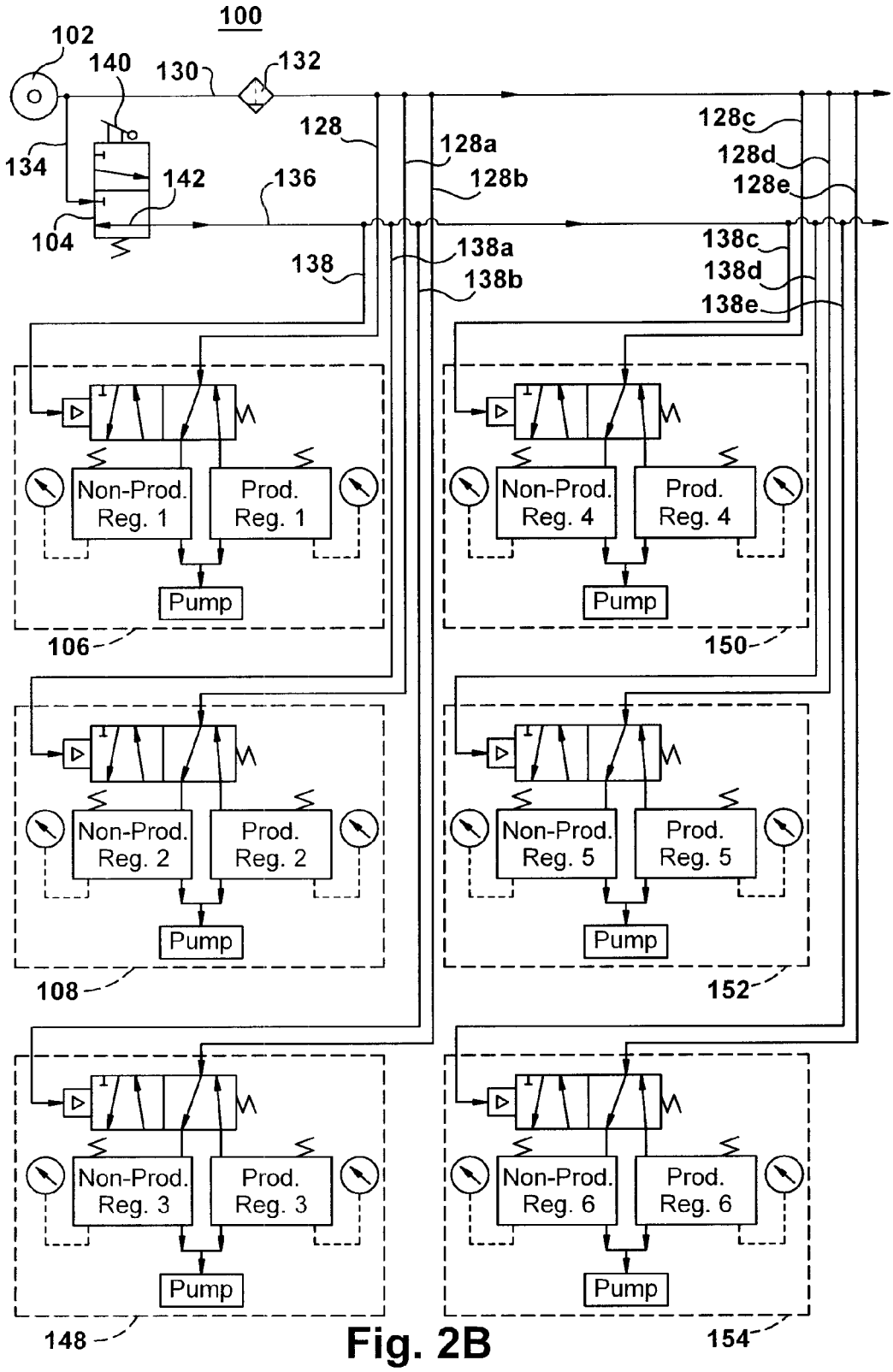
FIG. 2B is a block diagram showing an expanded system of pumps in a non-production state utilizing the control system according to the present invention.

As mentioned above, a typical system 100 is going to have more than two pump assemblies. With reference to FIGS. 2A and 2B, the system of the present invention having more than two pump assemblies is shown. First and second pump assemblies 106, 108, as well as a third pump assembly 148, a fourth pump assembly 150, a fifth pump assembly 152, and a sixth pump assembly 154 are included in the system 100 of FIGS. 2A and 213. Each of the pump assemblies 106, 108, 148, 150, 152, 154 is constructed identically, with the only difference therebetween being the settings of the regulators. Accordingly, each of the pump assemblies 106, 108, 148, 150, 152, 154 operates at a different output.

Further, each of the pump assemblies 106, 108, 148, 150, 152, 154 have a dedicated valve line 128, 128*a*, 128*b*, 128*c*, 128*d*, 128*e* and a dedicated pump assembly pilot line 138, 138*a*, 138*b*, 138*c*, 138*d*, 138*e*. Accordingly, all of the pump assemblies can be placed in the production state or the non-production state simultaneously through the operation of the manual actuator 140 on the switch 104.

Figure 3A:
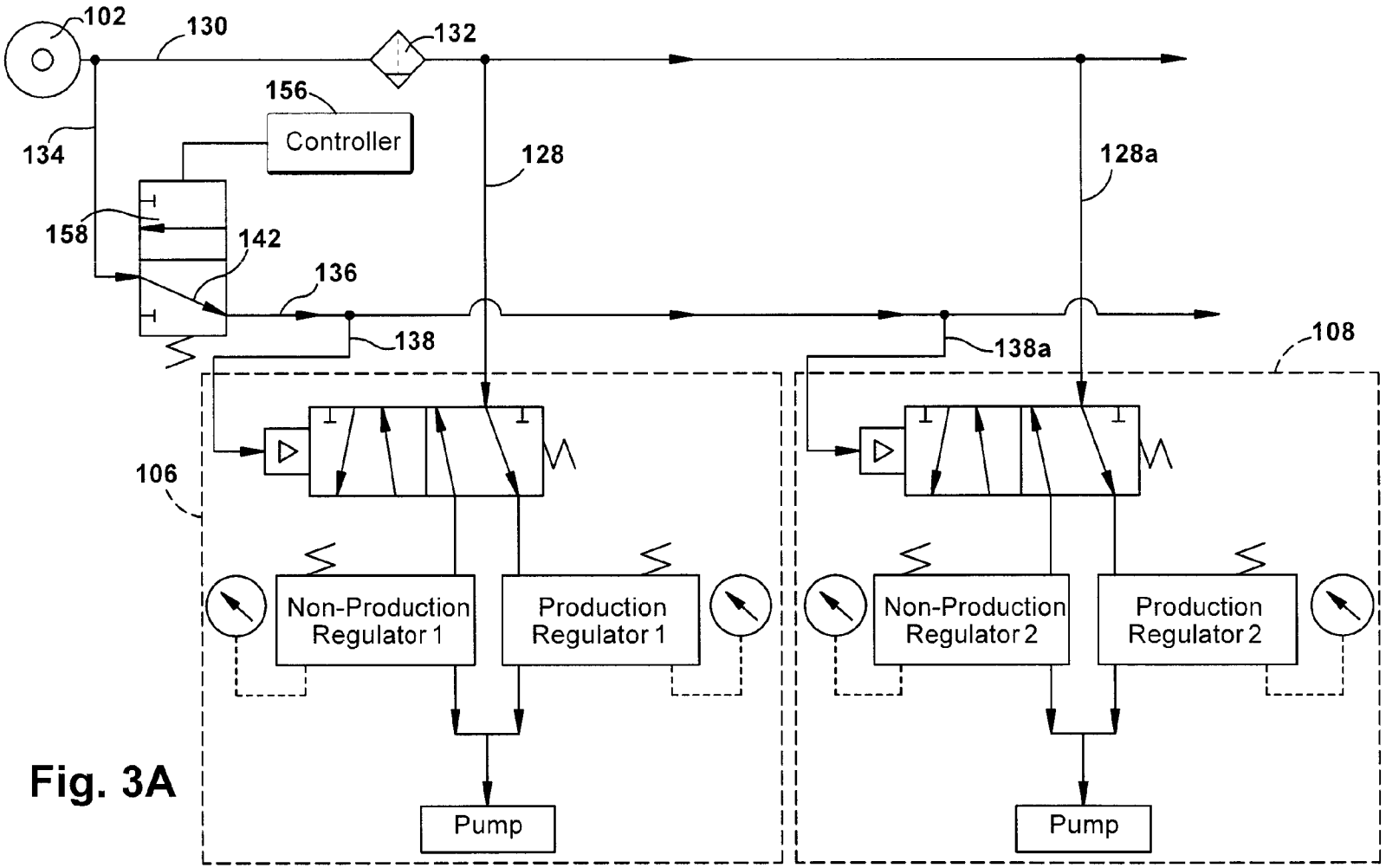
FIG. 3A is a block diagram illustrating a fully automatic control system for paint circulation pumps in the production state according to the present invention.
Figure 3B:
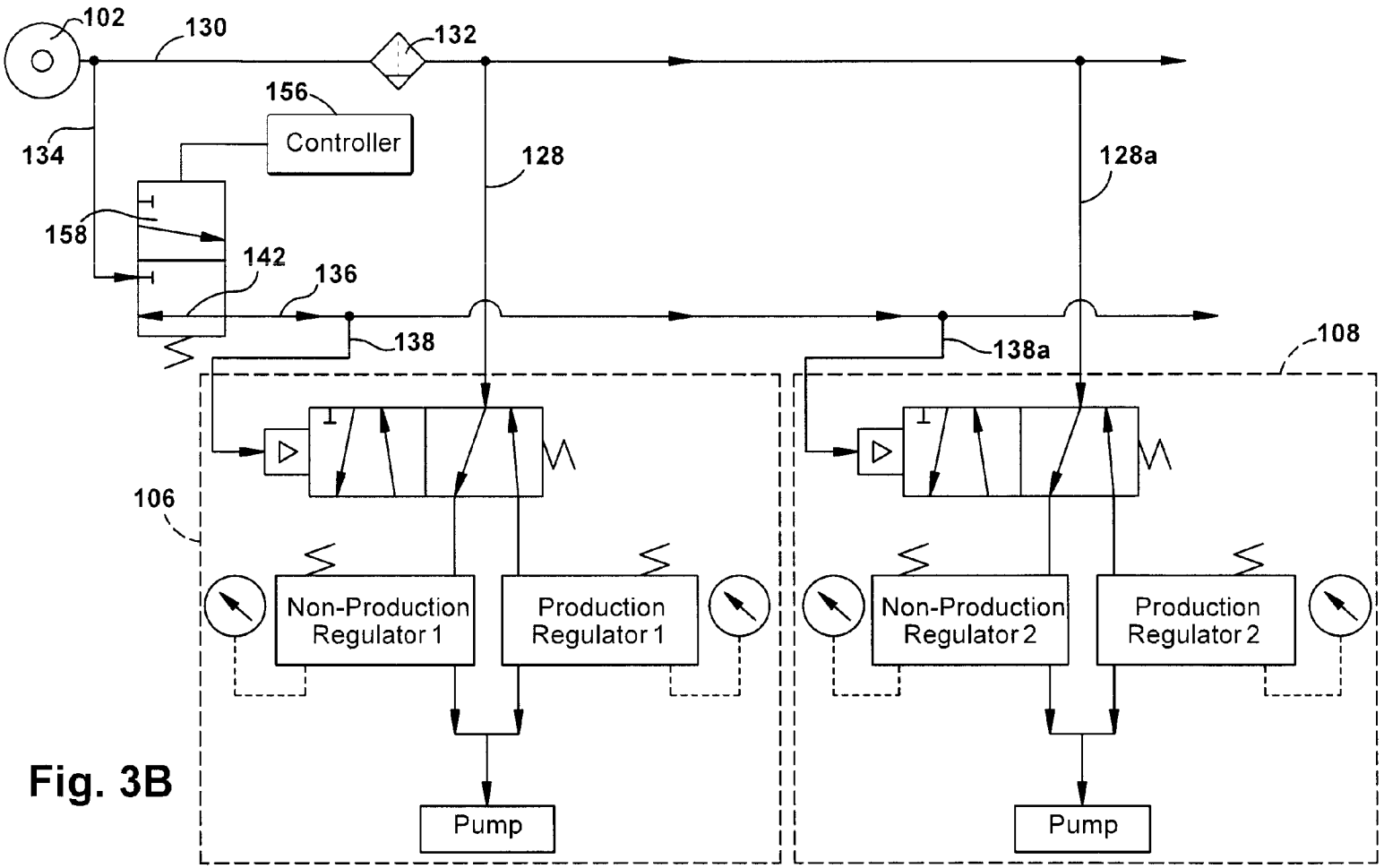
FIG. 3B is a block diagram illustrating a fully automatic control system for paint circulation pumps in the non-production state according to the present invention.

Turning to FIGS. 3A and 3B, a fully-automatic paint circulation pump control system 200 (hereinafter, "automatic system 200") is shown. The automatic system 200 of FIGS. 3A and 3B has a modification from the system 100 shown in FIGS. 1A, 1B, 2A, and 2B. The automatic system 200 shown in FIGS. 3A and 3B further includes a controller 156 and a modified switch 158.

The controller 156 is configured to receive a signal from the paint application system indicating whether the system should be in a production state or a non-production state. Based on the signal, the controller 156 controls the switch 158 to either connect the switch selector line 142 with the principal pilot line 136 or to disconnect the switch selector line 142 from the principal pilot line 136.

The switch 158 comprises an electric solenoid (not shown) that, when activated, drives the switch selector line 142 to connect to the principal pilot line 136, such that the principal pilot line 136 is in fluid communication with the compressed air source 102 via the introductory switch line 134. When the electric solenoid is deactivated, the switch selector line 142 disconnects the principal pilot line 136 from the compressed air source 102.

The controller 156 activates the electric solenoid in the switch 158 to connect the switch selector line 142 to the principal pilot line 136 by providing an electric current to the electric solenoid when the controller 156 receives a signal indicating that the paint application system is in a production state. When the controller 156 receives a signal indicating that the paint application system has changed to a non-production state, the controller 156 discontinues the electric current sent to the electric solenoid in the switch 158, thereby deactivating the electric solenoid and causing the switch selector line 142 to disconnect the principal pilot line 136 from the compressed air source 102.

The modification made to the paint circulation pump control system shown in FIGS. 3A and 3B allows the system to be fully automatic. While the system 100 shown in FIGS. 1A, 1B, 2A, and 2B requires the manual actuator 140 to be switched to the PRODUCTION position or the NON-PRODUCTION position depending on the current state of the paint application system, the automatic system 200 shown in FIGS. 3A and 3B automatically detects the production or non-production state of the paint application system, detects whether or not the switch selector line 142 is connected to the principal pilot line 136, and automatically adjusts the system.

Figure 4:
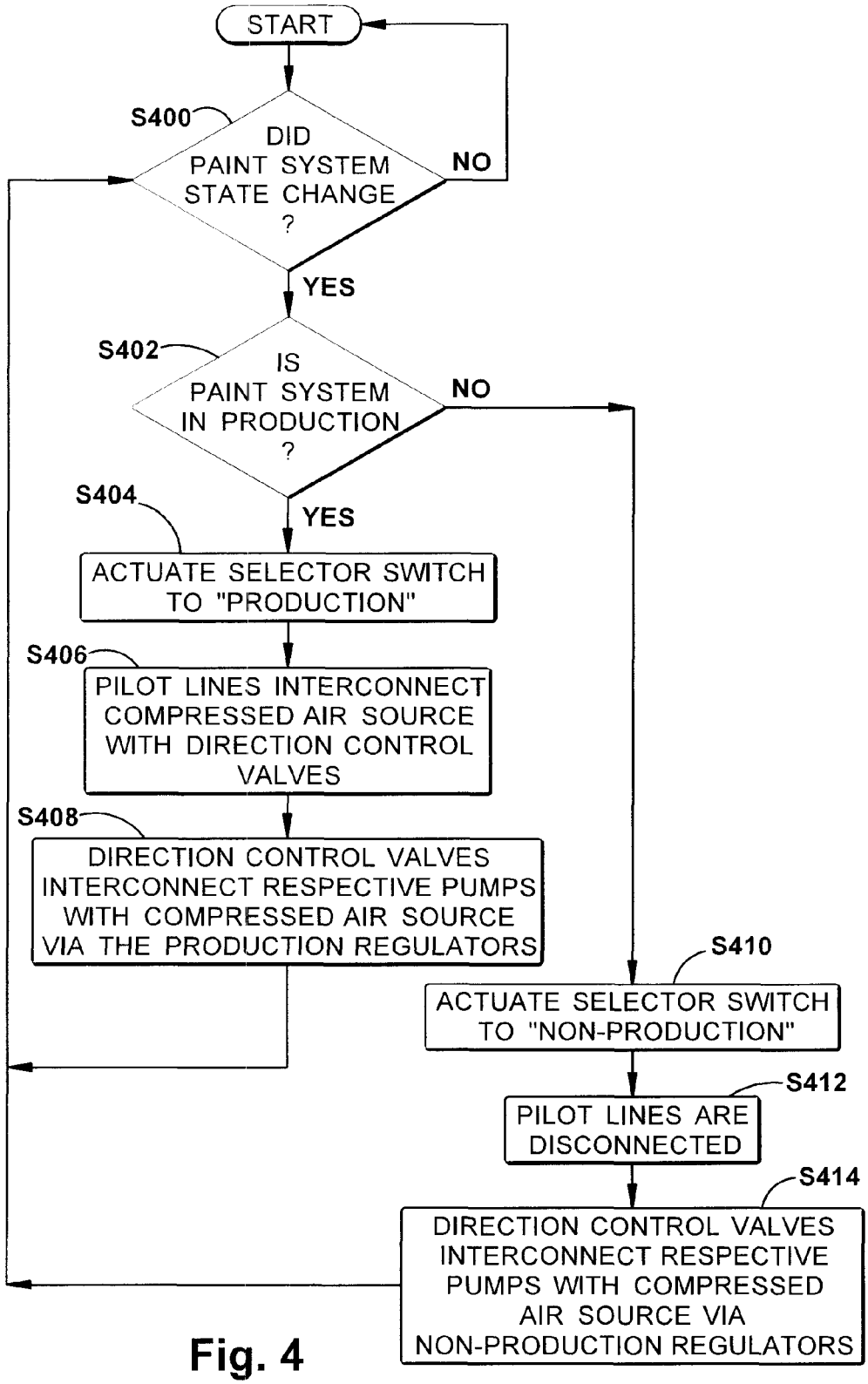
FIG. 4 is a flow chart illustrating a process for operation of the control system of the present invention.

Turning to FIG. 4, a flow chart illustrating an operating method for the system 100 is shown. It is further noted that the operating method for the automatic system 200 is the same as that for the semi-automatic system 100, with the only difference between the systems being the manner in which the switch is operated.

Initially, a detection of whether the paint application system state has changed is made (S400). The paint application system state changes when the system transitions from a production state to a non-production state or vice-versa. The detection of a change in the paint application system is made by an operator. If the paint application system state has not changed, then the paint circulation pumps are allowed to continue operating at the current output and the control system continues to monitor a change in the state of paint application system (S400, "NO").

If a change in the paint application system state is detected by an operator (S400, "YES"), then it is determined whether the paint application system has changed to a production state or a non-production state (S402). If it is determined that the paint application system has changed to a production state (S402, "YES"), the operator places the manual actuator 140 of the switch 104 in the PRODUCTION position (S404), thereby connecting the switch selector line 142 with the principal pilot line 136 (S406). Alternatively, if it is determined that the paint application system has changed to a non-production state (S402, "NO"), the operator places the manual actuator 140 of the switch 104 in the NON-PRODUCTION position (S410) and the switch selector line 142 is disconnected from the principal pilot line 136 (S412).

Depending on the particular change in the system, a set system response is initiated. If the change in the paint application system is from a non-production state to a production state, then once the principal pilot line 136 is connected to the introductory switch line 134 (S406), the control valve 110 operates to interconnect the pump 116 with the compressed air source 102 through the valve line 128 and the production regulator 112 (S408). If the change in the paint application system is from a production state to a non-production state, then once the principal pilot line 136 is disconnected from the introductory switch line 134 (S412), the control valve 110 operates to interconnect the pump 116 with the compressed air source 102 through the valve line 128 and the non-production regulator 114 (S414). Continued monitoring of the paint application system is then undertaken, so as to detect the next change in the paint application system state (S400).

If the automatic system 200 is used, then the detection of a change in the paint application system state and whether the current state is production or non-production is made by the controller 156. If in the production state, the controller 156 activates the electric solenoid in the modified switch 158, thereby automatically connecting the switch selector line 142 with the principal pilot line 136. Conversely, if the paint application system is in the non-production state, then the controller 156 deactivates the electric solenoid in the modified switch 158 and automatically disconnects the switch selector line 142 from the principal pilot line 136. As such, an operator does not need to monitor the paint application system for a state change, and further does not need to move the manual actuator 140 of the semi-automatic system 100.

In both the semi-automatic system 100 and the automatic system 200, a single switch provides a control for all associated pump assemblies, specifically controlling the assemblies such that either all of the control valves receive compressed air via their pump assembly pilot lines, or none of the control valves receive compressed air via their pump assembly pilot lines. Accordingly, when the manual actuator 140 position is changed, all of the pump assemblies 106, 108, etc. are directed to supply compressed air to the respective pump 116 via a different regulator. In other words, when the manual actuator 140 is in the PRODUCTION position, all of the pump assemblies provide compressed air to their pump via their production regulator. Conversely, when the manual actuator 140 is in the NON-PRODUCTION position, all of the pump assemblies provide compressed air to their pump via their non-production regulator. The automatic system 200 operates according to the same principle.

The above system allows for a ready change in compressed air and pump output according to load requirement differences in a production state and a non-production state. By flipping a single switch, in the semi-automatic system 100, the volume of compressed air can be regulated so as to prevent over-consumption, namely the over-consumption that occurs during non-production time. In the fully automatic system 200, the changeover is detected and there is no need to flip a switch. Accordingly, energy usage can be reduced and a cost savings can be achieved.

As an alternative to the above described embodiments, the non-production state can be made to correspond to the selector switch line interconnecting the principal pilot line with the compressed air source. In such an embodiment, the position of the production regulator and the non-production regulator must be reversed.

The energy usage reduction is achieved as a function of the non-production regulators regulating the compressed air passing through to a lower pressure. During non-production times, the load on the paint system is lowered, thereby allowing the paint circulation pumps to operate at a lower output. As an example, for a liquid paint color silver, the production regulator outputs compressed air at a pressure corresponding to an air flow rate of 13 standard cubic feet per minute, while the non-production regulator outputs compressed air at a pressure corresponding to an air flow rate of 9 standard cubic feet per minute.

The appropriate air pressure settings for the regulators, resulting in the appropriate pump output to ensure proper paint circulation, are dependent on the viscosity of the liquid paint. The general assumption by those skilled in the art of the behavior of liquid paint, especially organic solvent-based paint, is that liquid paint behaves as a Newtonian liquid, which is descriptive of a liquid having a viscosity that changes as a function of temperature and is independent of the shear rate.

Figure 5:
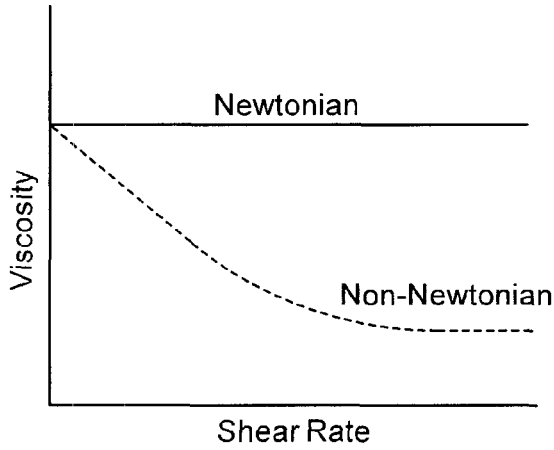
FIG. 5 is a graph of the viscosity of a Newtonian and Non-Newtonian liquid as a function of shear rate.

With reference to FIG. 5, a graph showing the viscosity of a liquid as a function of shear rate is shown. The solid line represents the expected behavior of a Newtonian liquid as a function of shear rate. Notably, as the viscosity of a Newtonian liquid is independent of the shear rate, the viscosity does not change as the shear rate increases. In contrast thereto, the behavior of a certain type of non-Newtonian liquid, represented by the dotted line in FIG. 5, exhibits a reduction in viscosity as the shear rate increases.

Figure 6:
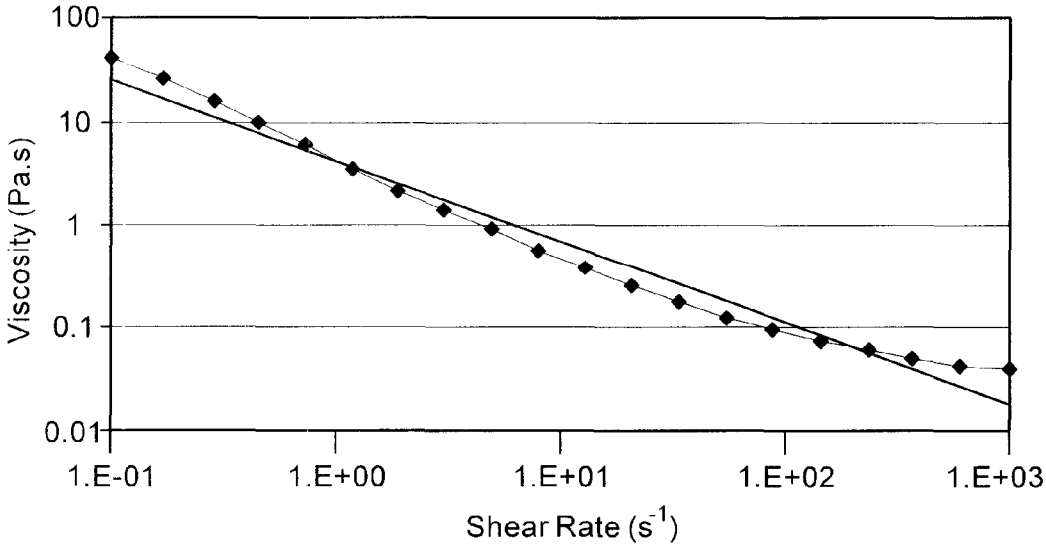
FIG. 6 is a graph of the observed viscosity of a paint liquid as a function of shear rate.

Following the general assumption in regards to liquid paint behavior, as the shear rate increases, the viscosity of the paint should remain constant. FIG. 6 is a graph of observed paint behavior, namely viscosity, as a shear rate was increased. Notably, as the shear rate increases, the paint viscosity decreases. By comparing the graph of FIG. 6 with the behavior of known non-Newtonian liquids, it was found that liquid paint behaves as a pseudoplastic type non-Newtonian liquid.

Thereby, the regulators of the present invention are set according to liquid paint behaving as a pseudoplastic type non-Newtonian liquid. In other words, the regulators are set with the knowledge that the paint viscosity is inversely proportional to the shear rate of the liquid paint. Thus, the regulator settings are more accurate. The below table illustrates the differences in regulator settings between treating liquid paint as a Newtonian liquid and as a non-Newtonian liquid.

Desired Regulator Settings of Newtonian Liquids and non-Newtonian Liquids

| | Paint Color: Silver |
|---|---|
| Production Regulator setting assuming Newtonian behavior | Pressure corresponding to air flow rate of 11 standard cubic feet per min |
| Non-Production Regulator setting assuming Newtonian behavior | Pressure corresponding to air flow rate of 8 standard cubic feet per min |
| Production Regulator setting assuming non-Newtonian behavior | Pressure corresponding to air flow rate of 13 standard cubic feet per min |
| Non-Production Regulator setting assuming non-Newtonian behavior | Pressure corresponding to air flow rate of 9 standard cubic feet per min |

As shown, a change in the desired air pressure output of the regulators is made when properly treating liquid paint as a pseudoplastic type non-Newtonian liquid. Notably, as the shear rate influences the viscosity of the paint, which alters the required pump output to properly circulate the paint, the regulators are set to a different air pressure output. The requisite pump output is determined by calculating the pressure drop of paint in the circulation piping loop. Accordingly, the settings of the regulators, particularly the non-production regulators, can be calculated and set more accurately.

Thus, the present invention employs dual-regulated pump assemblies having the air pressure regulators at settings governed by the behavior of the liquid paint as a pseudoplastic type non-Newtonian liquid. It is again noted that the present invention has been described in accordance with the exemplary embodiments illustrated in the figures. The description with reference to the drawings is made to facilitate the understanding of the invention, and is not meant limit the invention to the exemplary embodiments illustrated therein. Notably, a person of ordinary skill in the art will recognize that the present invention is amenable to various modifications and additions.

Particularly, any of the components of the present invention can be substituted for similar components that perform the same function. Namely, a different switch mechanism and direction control valves from those described above can be used. Further, the present invention is amenable to a configuration wherein the non-production regulator constantly feeds a set, lowered air pressure to the pump. With this configuration, a production regulator is selectively actuated so as to provide air pressure in addition to that provided by the non-production regulator when the paint application system is in a production state.

Additionally, the present invention is amenable for use with a hydraulic pump system. In this regard, the behavior of pressurized air (as a fluid) is similar to that of pressurized liquid. Accordingly, the present invention, notably the use and settings of dual-regulators associated with each pump, is considered amenable to hydraulic pumps.

Furthermore, the non-production and production states of the paint application system can be defined differently. As an example, the non-production state can be defined as a paint application system state wherein no paint is being requested by an operator. Conversely, the production state of the paint application system can be defined as a state wherein an operator is requesting paint. Herein, the request for paint is set as the actuation of a spray nozzle by an operator. Thus, when the operator actuates the spray nozzle, the paint application system is in the production state, and when the operator releases the nozzle, the paint application system is in the non-production state. By redefining the production and non-production states with use of the fully automatic system 200, the paint application system will toggle between the production and non-production states more frequently. As the paint application system will spend more time in the non-production state, an additional energy savings can be achieved.

Further still, a system of switches can be provided so as to place a subset of the paint lines in the production state while leaving a subset of the paint lines in the non-production state. While the above embodiments are directed to placing the entire paint application system into one of the production and non-production states, this modification allows certain paint lines to remain in the non-production state while other paint lines are placed in the production state.

The switches can be either manual switches, as used in the semi-automatic system 100, or can be switches controlled by a controller, as with the fully automatic system 200. The switches are nested so as to allow an operator or the controller to selectively place only a subset of the paint lines in the production state while leaving a subset of the paint lines in the non-production state. This modification allows the paint application system added flexibility so as to conserve energy by leaving paint lines that are not going to be used during the current shift in the non-production state.

Such a feature is particularly useful in paint application systems having certain colors that are more commonly applied than others. As an example, the color silver is a commonly applied color on a particular brand of automobile. Accordingly, the color silver is applied during every paint application shift. The color blue is a less frequently applied color, and is only applied during a few shifts a week. The paint circulation pump control system utilizing a system of switches can place the paint line communicating the silver paint in a production state while leaving the paint line communicating the blue paint in a non-production state. Thus, an energy savings is achieved by only placing the paint lines in a production state during shift where the paint color communicated by the paint lines is to be applied.

What is claimed is:

1. A control system for controlling the output of a pneumatic pump fluidly connected to a paint line, comprising:

a first regulator and a second regulator associated with the pneumatic pump, wherein the first regulator and second regulator are disposed between the pneumatic pump and a compressed air source at a position upstream from the pneumatic pump;

a control valve adapted to connect the pneumatic pump to the compressed air source via one of the first regulator and second regulator so as to supply pressurized air to the pneumatic pump, the control valve further adapted to switch the connection of the pneumatic pump to the compressed air source between being through the first regulator and being through the second regulator such that the pneumatic pump is connected to the compressed air source via only one of the first regulator and the second regulator at any one time; and a main switch operably connected to the control valve and adapted to actuate the control valve to switch between connecting the pneumatic pump to the compressed air source via the first regulator and connecting the pneumatic pump to the compressed air source via the second regulator, wherein the first regulator is adapted to supply pressurized air to the pneumatic pump at a first air pressure which generates a first pneumatic pump output, the second regulator is adapted to supply pressurized air to the pneumatic pump at a second air pressure which generates a second pneumatic pump output, and the first air pressure is greater than the second air pressure and the first pneumatic pump output is greater than the second pneumatic pump output.

2. The control system according to claim 1, wherein a main line fluidly connects the compressed air source to the control valve, and a pilot line selectively fluidly connects the compressed air source to the control valve via the main switch, wherein the control valve connects the main line to the pneumatic pump via one of the first regulator and the second regulator, and wherein the main switch is adapted to selectively connect and disconnect the compressed air source to the pilot line, wherein when the main switch connects the control valve to the compressed air source via the pilot line, the control valve is actuated to connect the pneumatic pump with the compressed air source via the main line and the first regulator, and when the main switch disconnects the control valve from the compressed air source via the pilot line, the control valve is actuated to connect the pneumatic pump with the compressed air source via the main line and the second regulator.

3. The control system according to claim 2, wherein the main switch is operable between a first position connecting the compressed air source to the control valve via the pilot line, and a second position disconnecting the compressed air source from the control valve via the pilot line.

4. A paint circulation pneumatic pump control system for controlling the output of a plurality of pneumatic pumps used in a paint circulation system, comprising:

a compressed air source;

a plurality of pump assemblies in fluid communication with the compressed air source via a main line, each of the pump assemblies including one of the plurality of pneumatic pumps, a first regulator, a second regulator, and a control valve, the first regulator and second regulator being disposed between the pneumatic pump and the compressed air source at a position upstream from the pneumatic pump, the control valve being adapted to connect the pneumatic pump to the compressed air source via one of the first regulator and second regulator so as to supply pressurized air to the pneumatic pump, and the control valve further adapted to switch the connection of the pneumatic pump to the compressed air source between being through the first regulator and being through the second regulator such that the pneumatic pump is connected to the compressed air source via only one of the first regulator and the second regulator at any one time, wherein the first regulator and the second regulator are set to regulate the air flow therethrough to different air pressures, the different air pressures yielding different pneumatic pump outputs; and a main switch operably connected to each of the control valves and adapted to actuate all of the control valves to simultaneously switch between connecting the associated pneumatic pump to the compressed air source via the first regulator and connecting the pneumatic pump to the compressed air source via the second regulator, such that the pneumatic pumps in all of the pump assemblies are one of: simultaneously connected to the compressed air source via the associated first regulator, and simultaneously connected to the compressed air source via the associated second regulator.

5. The paint circulation pneumatic pump control system according to claim 4, wherein the first regulator in each pump assembly is set to regulate air flow therethrough to a higher air pressure than that of the second regulator in that pump assembly.

6. The paint circulation pneumatic pump control system according to claim 5, wherein the first and second regulators in each pump assembly are set to output a different air pressure than the first and second regulators in other pump assemblies.

7. The paint circulation pneumatic pump control system according to claim 6, wherein the compressed air source outputs compressed air to the main line, the main line having a plurality of branch main lines stemming therefrom and each branch line connecting the main line to one of the plurality of pump assemblies.

8. The paint circulation pneumatic pump control system according to claim 7, wherein the compressed air source outputs compressed air to a principal pilot line, the principal pilot line having a plurality of branch pilot lines stemming therefrom and each branch pilot line connecting the principal pilot line to one of the plurality of control valves, wherein the main switch is disposed between the compressed air source and the principal pilot line and is operable to selectively connect and disconnect the compressed air source from the principal pilot line, wherein the main switch actuates the control valve to connect the branch main line with the pneumatic pump via the first regulator when the control valve receives compressed air via the branch pilot line, and wherein the main switch actuates the control valve to connect the branch main line with the pump via the second regulator when the control valve does not receive compressed air via the branch pilot line.

9. The paint circulation pneumatic pump control system according to claim 8, wherein the switch is operable between a first position and a second position, wherein the first position connects the principal pilot line with the compressed air source, and wherein the second position disconnects the principal pilot line from the compressed air source.

10. The paint circulation pneumatic pump control system according to claim 8, wherein the first and second regulators are set to yield a pump output sufficient to maintain paint circulation for liquid paint that acts as a pseudoplastic type non-Newtonian liquid.

11. The paint circulation pneumatic pump control system according to claim 4, wherein the first and second regulators in each of the pump assemblies are set to regulate the air pressure output so as to yield a pump output sufficient to maintain paint circulation for liquid paint that acts as a pseudoplastic type non-Newtonian liquid.

12. A method for controlling a plurality of paint circulation pneumatic pumps, comprising the steps of:

detecting a change in a state of a paint application system;

detecting whether the paint application system is in a production state or a non-production state;

connecting each of the plurality of pneumatic pumps with a compressed air source via a first regulator associated with each of the plurality of pneumatic pumps and disconnecting each of the plurality of pneumatic pumps from the compressed air source via a second regulator associated with each of the plurality of pneumatic pumps when a change in the state of the paint application system is detected and the paint application system is in a production state;

connecting each of the plurality of pneumatic pumps with the compressed air source via a second regulator associated with each of the plurality of pneumatic pumps and disconnecting each of the plurality of pneumatic pumps from the compressed air source via the first regulator associated with each of the plurality of pneumatic pumps when a change in the state of the paint application system is detected and the paint application system is in a non-production state, wherein the second regulator is set to supply the associated pneumatic pump with a lower air pressure than the first regulator.

13. The method according to claim 12, wherein each of the plurality of pneumatic pumps remains connected with the compressed air source via the connected one of the first and second regulators when there is no change in the state of the paint application system detected.

14. The method according to claim 12, wherein the first regulator and the second regulator are set to maintain a pump output required to circulate liquid paint that acts as a pseudoplastic type non-Newtonian liquid.

15. The method according to claim 12, wherein each of the plurality of pneumatic pumps has a first regulator and a second regulator unique thereto, and all of the plurality of pneumatic pumps are one of: simultaneously connected to the compressed air source via the first regulator and simultaneously connected to the compressed air source via the second regulator.

* * * * *